United States Patent [19]

Thérond

[11] Patent Number: 4,867,399

[45] Date of Patent: Sep. 19, 1989

[54] INSULATING EQUIPMENT FOR AN ELECTRIC LINE POLE AND METHOD FOR MAKING IT

[75] Inventor: Michel Thérond, Cahors, France

[73] Assignee: Manufacture D'Appareillage Electrique de Cahors, Cahors, France

[21] Appl. No.: 168,510

[22] Filed: Mar. 15, 1988

[30] Foreign Application Priority Data

Mar. 20, 1987 [FR] France ..... 87 03885

[51] Int. Cl.[4] ..... F16C 3/00

[52] U.S. Cl. ..... 248/65; 248/219.3; 174/45 R

[58] Field of Search ..... 248/65, 218.4, 58, 219.3; 174/45 R; 52/309.1, 309.7, 309.14; 428/229

[56] References Cited

U.S. PATENT DOCUMENTS

| | | | |
|---|---|---|---|
| 3,299,586 | 1/1967 | Hockaday | 174/45 R |
| 3,896,858 | 7/1975 | Whafley | 138/130 |
| 3,927,549 | 9/1979 | Seward et al. | 248/610 |
| 4,278,726 | 7/1981 | Wieme | 248/636 |
| 4,292,406 | 12/1980 | Bouhrini et al. | 52/309.14 |
| 4,539,055 | 9/1985 | Orcutt | 428/36 X |
| 4,695,677 | 9/1987 | Ruth et al. | 248/654 |

*Primary Examiner*—Alvin C. Chin-Shue

*Attorney, Agent, or Firm*—Kenyon & Kenyon

[57] ABSTRACT

Insulating equipment (100) includes a flexible arm (1) having at one of its ends a means for attachment to a pole and at the other end means for attaching an electric line substantially perpendicular to the arm (1). The thickness of the arm (1) decreases regularly from the means fo attachment to the pole toward the means of attachment to the electric line, while the height of the cross section of the arm is constant. The arm (1) has in the direction of its thickness a series of layers (*7a, 7b, 7c, 7d*) of continuous mineral fibers extending in the direction of the arm's length and separated by layers (*8a, 8b, 8c, 8d*) of randomly-oriented short mineral fibers. These layers are bonded by a synthetic resin in which a layer (*9a, 9b*) of fabric of mineral fibers may be placed on each side of the arm (1) between the first layer of short fibers and the following layer of continuous fibers.

To be used for improving longitudinal flexibility and resistance to vertical loads.

10 Claims, 4 Drawing Sheets

INSULATING EQUIPMENT FOR AN ELECTRIC LINE POLE AND METHOD FOR MAKING IT

BACKGROUND OF THE INVENTION

This invention relates to insulating equipment for an electric line pole and to a procedure for manufacturing said equipment.

The electric lines used to carry electricity under low, medium, and high tension are supported by poles or pylons by the use of insulating brackets called "equipment."

In its uses to date, this equipment is made up of metallic pieces provided with means for attachment to the post and with means for hanging the electrical lines in a direction perpendicular to the equipment.

These braces are rigid, and thus cannot be bent by forces applied to the electrical lines. But the electrical lines may be subjected to unusually heavy loads due to frost, snow, or wind.

Given that these loads do not lead to any deformation of the equipment, the above-mentioned unusually heavy loads may cause the line to break, which in turn would cause torque that could lead the pole to break.

To avoid such problems it has been proposed that the equipment be made of a flexible material of glass fiber-reinforced synthetic resin and having a cross section that decreases regularly from the pole.

Ideally this equipment should have the greatest possible longitudinal flexibility, while also being able to support the greatest possible vertical loads. In practice, such a compromise is difficult to realize.

SUMMARY OF THE INVENTION

The object of this invention is to create equipment that makes it possible to attain the above-mentioned objective, while also being inexpensive.

The equipment of this invention comprises a flexible arm which is provided at one end with means for attaching it to the pole, and at the other end with means for attaching to it an electric line approximately perpendicular to the arm. The arm has a rectangular cross section, with a height of the section being measured in a plane perpendicular to the electrical line and a width being measured in a direction parallel to the electrical line. The height is greater than the width.

According to the invention, the width of this cross section decreases regularly from the point at which the equipment is attached to the post to the point at which it is attached to the electrical line; whereas the height of the cross section is constant; the arm, in the direction of its thickness, has a series of layers of continuous mineral fibers extending in the direction of the arm's length, each separated by a layer of short randomly-oriented short mineral fibers, these fibers and layers being bonded by a synthetic resin.

This succession of layers of mineral fibers coated in a synthetic resin gives the equipment, by virtue of its geometry, great longitudinal flexibility, as well as great resistance to vertical loads.

The layers containing continuous fibers extending along the length of the equipment, and embedded in the synthetic resin, because they are disposed in vertical planes, make the equipment extremely resistant to vertical loads, as well as resistant to breaking under high flexure. Moreover, because the cross section of the equipment has a much greater vertical dimension than in the longitudinal direction of the electric line, and because this section decreases regularly from the pole, the equipment has great longitudinal flexibility.

The layer containing randomly-oriented short fibers makes it possible to distribute the thermal and mechanical stress among the above-mentioned layers of continuous fibers.

Moreover, this intermediate layer of randomly-oriented short fibers makes it possible to perforate the arm. In fact, if the equipment had only the continuous longitudinal fibers, perforation of the equipment would cause delamination.

To increase the equipment's resistance to torsional stress, a layer of a fabric of mineral fibers is placed on each side of the arm between the first layer of short fibers and the next layer of continuous fibers. This fabric should enclose fiber filaments placed at +45° and −45° to the direction of the length of the equipment, which will make it possible to obtain optimal resistance to torsion.

Thus, the functions of the different successive layers of the equipment, according to the invention, jointly contribute to making a device that has the desired mechanical properties.

According to a preferred embodiment, the proportion of continuous fibers is greater than that of short fibers.

This proportion is based on the primary role of the continuous fibers in obtaining the sought-after mechanical properties. It is also advisable to use the greatest possible number of continuous fibers.

According to a preferred version of the invention, certain layers of short fibers are separated from the next layer of continuous fibers by supplementary layers of short fibers that extend over only a part of the length of the arm from the end that attaches to the post. The lengths of these layers of short fibers diminish progressively from the exterior to the middle of the thickness of the arm to produce a regularly decreasing thickness of the arm from the post to the end of the equipment intended to support the electric line.

Preferably, the exterior surface of the arm is covered by a plastic coating resistant to electric arcing, inclement weather, and ultra-violet rays, made of a material such as an ethylene-propylene-diene-methylenic (EPDM) copolymer.

According to another aspect of the invention, the procedure for manufacturing insulating equipment for electric line poles comprises the following steps:

making strips containing a layer of continuous fibers that extend along the length of the strip and a layer of randomly-oriented short fibers pre-impregnated with polyester resin and possibly strips of a fabric of fibers at ±45° to the lengthwise direction of the strip;

cutting these strips to the dimensions of the desired length and height of the equipment;

stacking the different strips according to the desired placement;

preheating this stack to a temperature below the polymerization temperature of the polyester resin;

placing the stack in a mold, and heating and applying pressure to mold the stack.

Other features and advantages of the invention will be described below.

BRIEF DESCRIPTION OF THE DRAWINGS

The following drawings are given as nonlimiting examples.

DETAILED DESCRIPTION OF THE PREFERRED EMBODIMENTS

Figure 1:
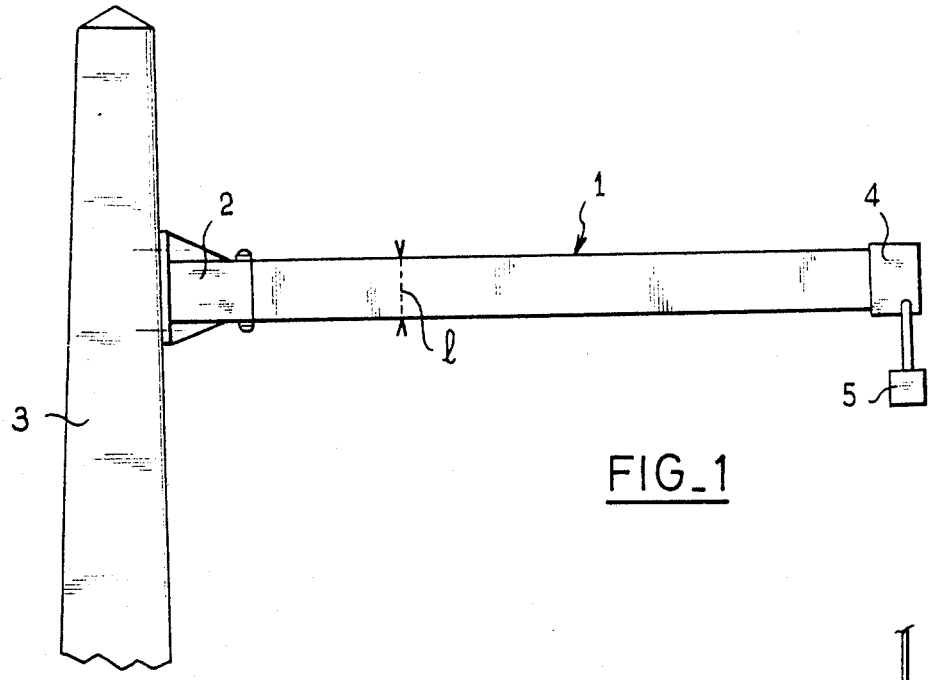
FIG. 1 is an elevation view showing the upper part of a pole outfitted with the equipment described by this invention.
Figure 2:
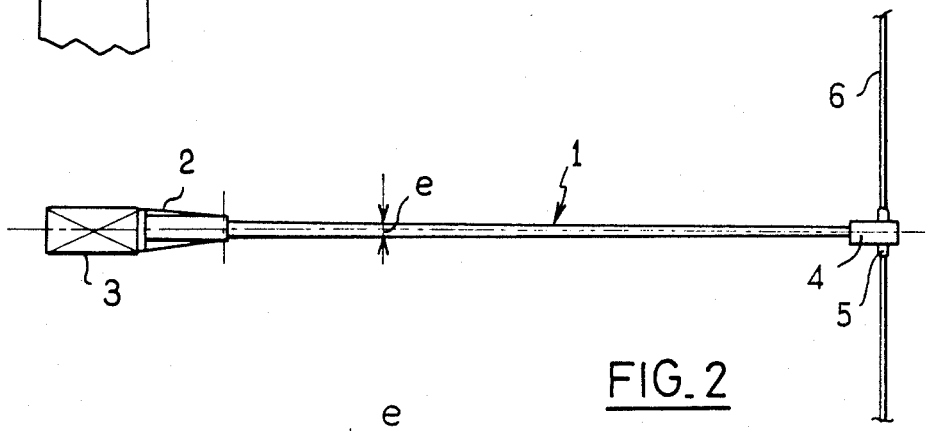
FIG. 2 is a top plan view of FIG. 1.
Figure 3:
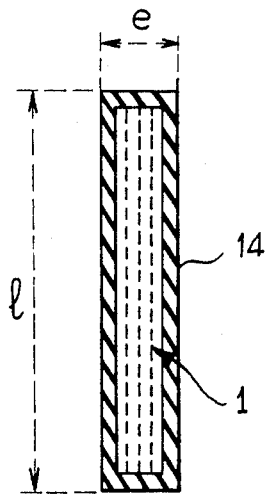
FIG. 3 is an elevation view in transverse cross section, at a larger scale, of the equipment.

In the embodiment of FIGS. 1 and 2 a lateral equipment 100 is constituted by a flexible arm 1 having at one end a support 2 to attach it to a pole 3 and at its other end a tip 4 carrying a cable clamp to which is attached an electric line 6 extending perpendicularly to arm 1. Arm 1 has a rectangular transverse cross section (see FIG. 3). The height 1 of this section measured in a plane perpendicular to the electrical line 6 is clearly greater than the width e of this section measured in a direction parallel to the electrical line 6 in the plane of FIG. 2.

As can be observed in FIG. 2, the width e of the transverse cross section of arm 1 decreases regularly from the support 2 of the attachment to the pole 3, toward the tip 4 for attachment to the electrical line 6. In addition, the height 1 of this section is constant (see FIG. 1).

Figure 4:
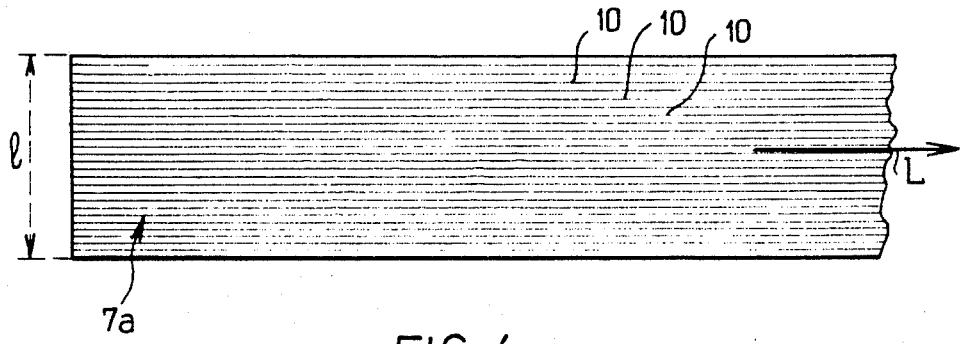
FIG. 4 is a schematic elevation view of part of a layer containing continuous longitudinal fibers.
Figure 5:
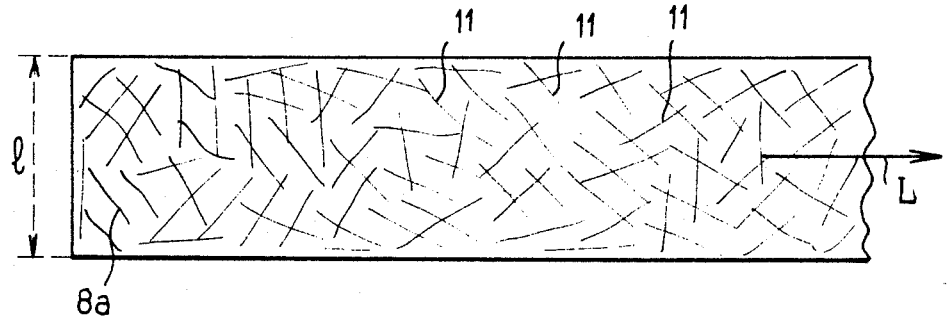
FIG. 5 is a schematic elevation view of part of a layer containing randomly-oriented continuous fibers.
Figure 7:
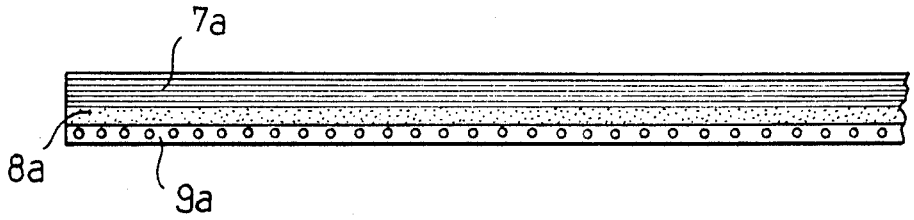
FIG. 7 is a schematic plan view in longitudinal cross section showing the juxtaposition of the layers of FIGS. 4, 5, and 6.

The arm 1 has in the direction of its thickness e, i.e., in the plane of FIG. 2, a series of layers *7a, 7b, 7c, 7d* of continuous glass fibers 10 (see FIGS. 4, 7, 8) extending in the direction of the length L of arm 1. These layers *7a, 7b, 7c, 7d* are separated by layers *8a, 8b, 8c, 8d* of randomly-oriented short glass fibers 11 (see FIGS. 5, 7, 8). These two layers and their fibers are bonded by a synthetic resin, such as a polyester resin.

In addition, layers *9a, 9b* of glass fiber fabric are disposed (see FIG. 8), one on each side of the arm 1, between the first layer of short fibers 11 and the next layer *7b* of continuous fibers 10.

The diffferent layers are distributed symmetrically on either side of the neutral fiber N of arm 1.

The different layers, such as *7a, 8a, 9a* are bonded by polymerization of the synthetic resin, using a pressure molding operation that will be described below.

The proportion of continuous fibers 10 preferably should be greater that of short fibers 11. The continuous fibers 10 should account for approximately 80% of the weight of all the fibers, the short fibers 11 thus accounting for approximately 20% of the total.

The continuous fibers 10 and short fibers 11 preferably should account for 50 to 60% of the total mass, the proportion of synthetic resin thus accounting for 40 to 50%.

Figure 6:
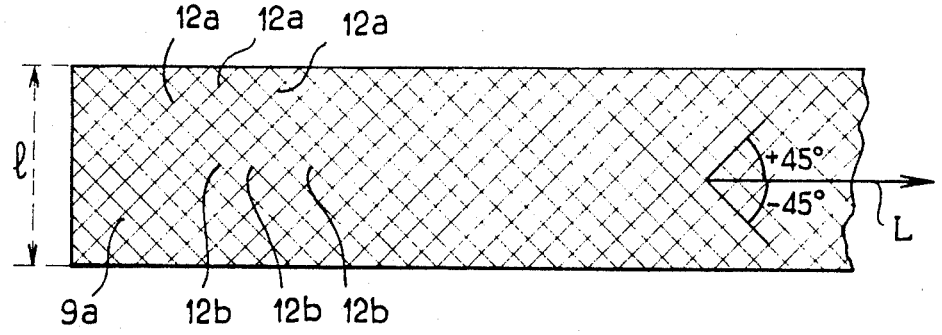
FIG. 6 is a schematic elevation view of part of a fabric of fiber filaments disposed at ±45°.

The fabric *9a* (or *9b*) (see FIG. 6) has a first series of filaments *12a* of parallel glass fibers placed at +45° with respect to the direction of the length L of the arm 1, and a second series of filaments *12b* of parallel fibers placed at −45° with respect to that direction.

Figure 8:
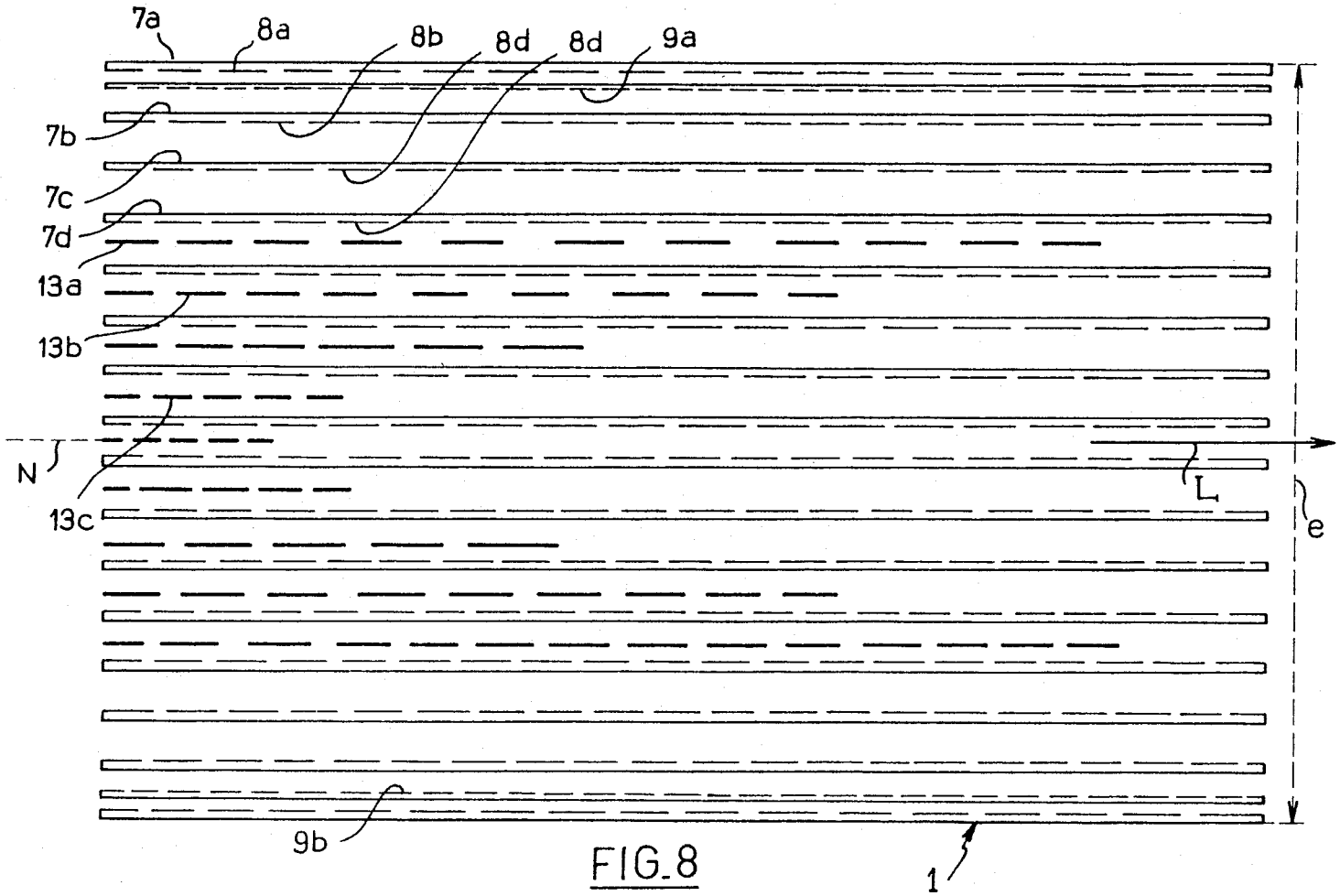
FIG. 8 is a schematic plan view of the equipment in longitudinal cross section showing the different layers of this equipment according to the invention.

Furthermore, one can observe in FIG. 8 that certain layers of short fibers such as *13a, 13b, 13c* extend along only a part of the length L of the arm 1 from the support 2 where it is attached to the pole 3. The lengths of these layers of short fibers *13a, 13b, 13c* diminish progressively from the exterior toward the middle N of the thickness of the arm 1 to produce a thickness e that decreases regularly, as indicated in FIG. 2.

Moreover, the exterior surface of the arm 1 is covered (see FIG. 3) with a coating 14 made of elastomer resistant to electric arcing, inclement weather, and ultra-violet rays, such as an ethylene-propylene-diene-methylenic (EPDM) copolymer.

The support 2 that attaches the arm 1 to the pole 3, as well as the tip at end 4, preferably are made of aluminum and are fixed to the arm 1 by gluing. Of the common metals, aluminum has the expansion coefficient closest to that of the composite material (glass fibers, polyester resin) of which arm 1 is made, so that the bonding of the support 2 and the tip 4 to the arm 1 do not run the risk of being affected by variations in temperature.

Following is a detailed description of the procedure for manufacturing the equipment in accordance with the invention.

In a first step, a strip is made that comprises, in succession, a layer of continuous glass fibers 10 that extend along the length of the strip, a layer of randomly-oriented short fibers 11, and a layer of fabric *9a* of glass fiber filaments *12a, 12b* forming an angle of ±45° with respect to the length L of the strip. Together these layers are pre-impregnated with a polyester resin.

The make-up of this strip might be, for example, as follows:

| | |
|---|---|
| polyester resin | 18% |
| shrink-proof thermoplastic agent | 12% |
| adjuvant, coloring catalyst | 3% |
| mineral fillers | 12% |
| glass fibers | 55% |

The strips, pre-impregnated with polyester resin, are then cut to the dimensions of the arm 1.

The strips are then stacked following the distribution illustrated in FIG. 8.

The stack thus made is then placed in a high-frequency pre-heater for heating to approximately 70° C. (a temperature less than the polymerization temperature of the polyester resin).

This preheating makes it possible to significantly diminish the thermal stress within the material when the molding is performed.

Figure 9:
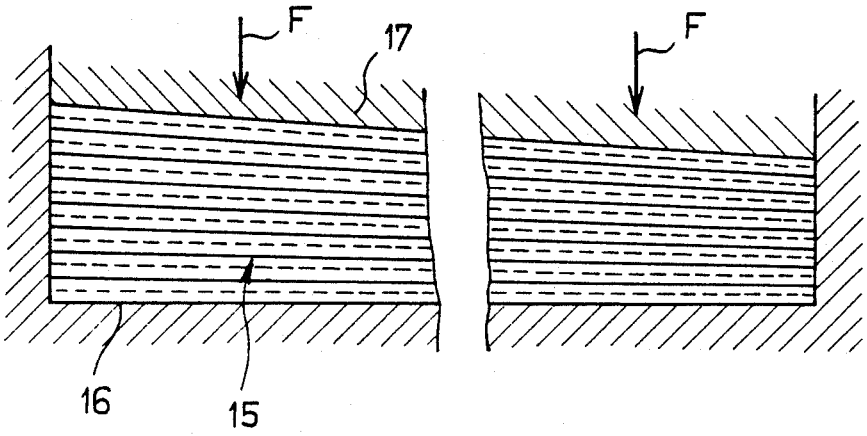
FIG. 9 is a longitudinal cross-section of a mold illustrating the procedure for manufacturing the equipment according to the invention.

The resulting stack 15 is then placed in a mold (see FIG. 9) of two parts 16 and 17 placed in a press. The stack 15 is heated to the polymerization temperature of the polyester resin, all the while applying pressure (see arrows F in FIG. 9).

The stack 15 is then withdrawn from the mold, trimmed, cooled, and then sanded or pumiced to obtain the best possible surface.

The aluminum support 2 and tip 4 are then bonded to the ends of the stack.

The adhesive used for this can be a semiconductive adhesive to avoid problems of partial discharges. The exterior surface of the arm thus obtained is then coated with a primary adhesive and then a coating of EPDM.

For a given flexibility, the equipment thus produced is more resistant to vertical loads than equipment of constant cross section and inertia produced, for example, by drawing through a die.

Thus, such equipment produced in accordanc with the invention, with a length L equal to 150 cm, a height 1 equal to 90 mm, and a thickness e decreasing from 25 to 20 mm supports a static vertical load greater than 240 daN and has a longitudinal flexibility greater than 5 mm/daN.

These mechanical properties result from the fact that the equipment encompasses a large proportion of continuous longitudinal fibers 10. The fabric having glass fiber filaments 12*a* and 12*b* forming angles of +45° and −45° with the direction of the length L of the equipment makes it possible to increase the torsion resistance of the equipment, while the layers enclosing the randomly-oriented short glass fibers 11 make it possible to distribute the thermal and mechanical stresses among the fabric and the adjacent long-fiber layers and to perforate the arm 1 without risk of delamination.

In the case in which the equipment is intended to withstand less torsional stress, the presence of fabric 9*a*, 9*b* is not necessary.

It should be understood that the invention is not limited to the embodiments which have just been described; various modifications can be made within the framework of the invention.

Moreover, the glass fibers can be replaced by other mineral fibers such as rock fibers.

Also, the polyester resin can be replaced by a heat set or thermoplastic resin.

In addition, the dimensions of the arm 1 can be modified according to needs.

Also, arm 1, instead of being perpendicular to the pole 3 can be placed at an oblique angle.

In addition, in the process for manufacturing the equipment, instead of stacking the strips of pre-impregnated fibers, cut to the dimensions L and 1 of the equipment, on top of one another, one can proceed as follows:

A sheet having a length L of the equipment and having a layer of continuous fibers and a layer of short fibers pre-impregnated with resin is rolled so as to form a flattened spiral comprising strips of maximum width equal to 1 bonded to one another. Thus, a stack is made composed of successive layers of continuous fibers and short fibers.

To obtain a decreasing thickness, variable length strips, such as the short-fiber layers (13*a*, 13*b*, 13*c*) shown in FIG. 8, are intercalated between the layers of the spiral.

I claim:

1. Insulating equipment for a pole to support electric lines constituting a flexible arm comprising at one end means for attaching it to the pole and at the other end means for attaching an electric line substantially perpendicular to the arm, this arm having a rectangular transverse section, the height of this section measured in a plane perpendicular to the electric line being greater than the thickness of this section measured in a direction parallel to the electric line, the thickness of this section decreasing regularly from the means for attaching it to the pole towards the means for attaching it to the electric line, the height of this section being constant, with the arm having in the direction of its thickness, a succession of layers of continuous mineral fibers extending in the direction of the length of the arm, separated by a layer of short mineral fibers randomly oriented; these fibers and these layers being bonded to each other by a synthetic resin.

2. Equipment according to claim 1, having a layer of fabric of mineral fibers placed on each side of the arm between the first layer of short fibers and the following layer of continuous fibers following.

3. Equipment according to claim 1, wherein the proportion of continuous fibers is greater than the proportion of short fibers.

4. Equipment according to claim 3, wherein the proportion of continuous fibers is superior to the proportion of short fibers.

5. Equipment according to claim 1, in which mass of fibers accounts for 50 to 60% of the total mass of the arm without the attaching means.

6. Equipment according to claim 1, in which said synthetic resin is a polyester resin.

7. Equipment according to claim 2, in which the fabric has a first series of parallel fiber filaments placed at +45° with respect to the direction of the length of the arm and a second series of parallel fiber filaments placed at −45° with respect to this direction.

8. Equipment according to claim 1, having certain layers of short fibers (ii) that are separated from the layer of continuous fibers followed by a layer of short fibers or of continuous fibers that extend over only one part of the length of the arm from the means of attachment to the pole, the length of this layer of short fibers or continuous fibers diminishing progressively from the exterior towards the middle of the thickness of the arm resulting in a thickness that decreases regularly.

9. Equipment according to claim 1, in which the exterior surface of the arm is covered by a coating of elastomer resistant to the electric arcing, inclement weather, and ultraviolet radiation.

10. Equipment according to claim 8, in which the coating is a ethylene-propylene-dienemethylenic copolymer.

* * * * *